US010051954B2

(12) United States Patent
Grace

(10) Patent No.: US 10,051,954 B2
(45) Date of Patent: Aug. 21, 2018

(54) BI-FOLD FURNITURE

(71) Applicant: Daniel R. Grace, Old Saybrook, CT (US)

(72) Inventor: Daniel R. Grace, Old Saybrook, CT (US)

(73) Assignee: GCI OUTDOOR, INC., Higganum, CT (US)

( * ) Notice: Subject to any disclaimer, the term of this patent is extended or adjusted under 35 U.S.C. 154(b) by 0 days.

(21) Appl. No.: 14/991,054

(22) Filed: Jan. 8, 2016

(65) Prior Publication Data

US 2016/0198857 A1 Jul. 14, 2016

Related U.S. Application Data

(60) Provisional application No. 62/101,360, filed on Jan. 8, 2015.

(51) Int. Cl.
*A47B 3/04* (2006.01)
*A47C 4/28* (2006.01)

(52) U.S. Cl.
CPC ..... *A47B 3/04* (2013.01); *A47C 4/286* (2013.01)

(58) Field of Classification Search
CPC ..... A47C 4/286; A47B 3/04
USPC ..... 297/44
See application file for complete search history.

(56) References Cited

U.S. PATENT DOCUMENTS 6,062,648 A * 5/2000 Adler ..... A47C 4/02 297/44
6,364,409 B1 * 4/2002 Saul ..... A47C 4/286 297/44 X
8,251,442 B2 * 8/2012 Grace ..... A47C 4/286 297/16.2
8,864,222 B2 * 10/2014 Grace ..... A47C 4/286 297/44

* cited by examiner

*Primary Examiner* — Anthony D Barfield
(74) *Attorney, Agent, or Firm* — McCormick, Paulding & Huber LLP

(57) ABSTRACT

A folding furnishing apparatus includes first members that support at least one flexible panel in a set-up configuration; second members that support the plurality of first members; first joints that connect the plurality of first members and that in the set-up configuration define mutually skewed axes about which the furnishing cannot be folded, thus locking the first members in extended positions; and second joints that connect the second members to the first members. The second joints in the set-up configuration define mutually parallel axes about which the second members can be folded to a mutually nested configuration. The first joints in the mutually nested configuration then define mutually parallel axes about which the first members can be folded to a collapsed configuration.

23 Claims, 8 Drawing Sheets

BI-FOLD FURNITURE

CROSS REFERENCE TO RELATED APPLICATION

This application claims priority to, and hereby incorporates by reference in its entirety, U.S. Patent Application 62/101,360, filed Jan. 8, 2015.

BACKGROUND

Technical Field

The invention relates to folding portable furnishings, e.g., lawn or beach chairs, cots, tables, and the like.

Discussion of Art

Folding furniture, generally, is well known and has been used a long time. The general intent of folding furniture is ease of storage and portability, i.e., the furniture can be set-up for use and then folded down for transport and/or storage in a space of smaller volume than what the furniture occupies in its set-up condition. It also has been noted that it would be desirable to have the furniture fold down to fit within a space of minimum possible perimeter, i.e., for purposes of shipping the furniture at a minimal rate when the shipping rate is based in part on the volume and perimeter of the package to be shipped. However, the collapsibility of known folding furniture has been limited by certain design features, for example, the mutual arrangement of members to fold against each other without needing to disassemble and re-assemble the article.

Additionally, it would be desirable to have a folding furnishing that does not easily or unintentionally collapse from its set-up condition, especially when in use, and that tends to remain in its folded condition, for example, during storage and/or transport.

BRIEF DESCRIPTION

According to embodiments of the invention, in a set-up configuration of a folding portable furnishing (e.g., a chair, although other furnishings can be similarly constructed as will be apparent to ordinary skilled workers), the furnishing includes a plurality of pivotally interconnected frame members as well as a first plurality of pivots or joints that define mutually parallel axes about which the furnishing can be folded in a single motion from the set-up configuration to a flattened configuration. The furnishing also includes a second plurality of pivots or joints that define mutually skewed axes about which the furnishing cannot be folded from the set-up configuration. However, in the flattened configuration of the furnishing, the second plurality of pivots then define parallel axes about which the furnishing can be folded from the flattened configuration to a collapsed configuration. Thus, the first and second pluralities of pivots provide for the furnishing to be an item of "bi-fold" furniture to reduce the footprint (perimeter) of the furnishing in its fully collapsed condition.

In certain embodiments, in the collapsed configuration of the furnishing, the first plurality of pivots define offset axes (i.e., parallel axes that are not in a common plane) about which the furnishing cannot be unfolded from the collapsed configuration via the first plurality of pivots without first unfolding the furnishing to its flattened configuration via the second plurality of pivots.

According to embodiments of the invention, a folding portable furnishing includes cross members that support a panel for receiving an occupant, as well as side frame members that support the panel and/or support the cross members. At least some of the side frame members are laterally nested within others of the side frame members, so that all of the side frame members can be folded into a substantially common plane not thicker than the thicknesses of two cross members. In further embodiments, the cross members can be mutually disposed so that they, also, can be folded with the side frame members in a lengthwise nested fashion into the substantially common plane, not thicker than the thickness of one cross member.

An exemplary embodiment of the invention, as briefly described above, is further explained below by reference to the following figures.

DRAWINGS

DETAILED DESCRIPTION OF THE DRAWINGS

Figure 1:
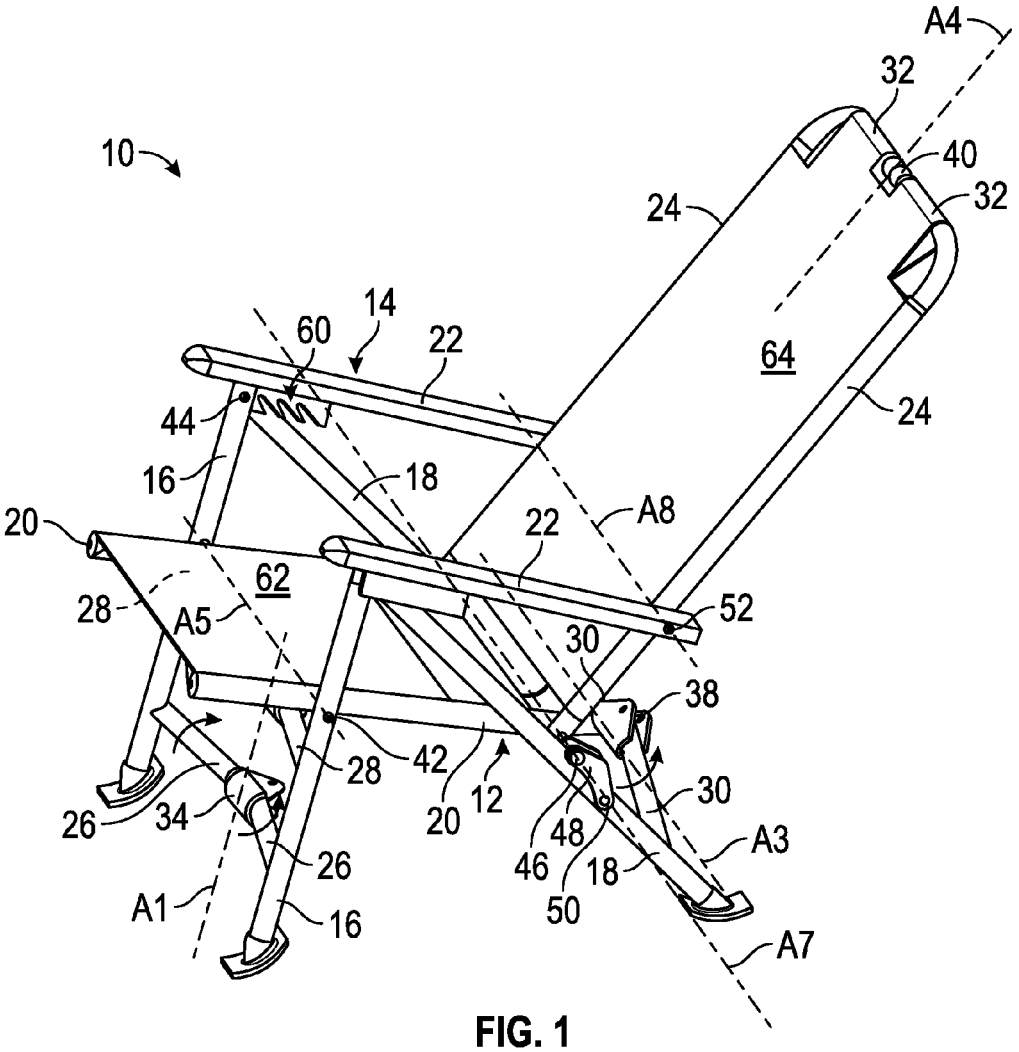
FIG. 1 shows a bi-fold chair, in accordance with a first embodiment of the present invention, in a set-up configuration.

Although embodiments of the invention are shown in the drawings and are described as relating to a chair or to a cot, aspects of the invention more generally may be applicable to other furnishings, e.g., tables, stools, and the like.

FIG. 1 shows a portable and collapsible bi-fold chair 10 in a set-up configuration. The chair 10 has left and right side frame members that support fabric seating panels. The side frame members are directly pivotally connected with each other, and also are connected by cross members. The cross members are rigidly and generally orthogonally connected to the side frame members and are mutually pivotally connected at a vertical mid-plane of the chair. More particularly, the side frame members are arranged symmetrically in a left plurality 12 and a right plurality 14. Each plurality 12, 14 of side frame members includes a front leg 16, a rear leg 18, a seat support 20, an arm rest 22, and a back support 24. The front legs 16 are cross-connected by lower leg braces 26 and upper leg braces 28. The rear legs 18 are cross-connected by rear braces 30. The back supports 24 are cross-connected by top braces 32.

Each lower leg brace 26 is rigidly attached to its respective front leg 16, and is pivotally connected by a lower joint 34 to the other lower leg brace 26. Each upper leg brace 28 is rigidly attached to its respective front leg 16, and is pivotally connected by an upper joint 36 to the other upper leg brace 28. Each rear brace 30 is rigidly attached to its respective rear leg 18, and is pivotally connected by a rear joint 38 to the other rear brace 30. Each top brace 32 is rigidly attached to its respective back support 24, and is pivotally connected by a top joint 40 to the other top brace 32.

Each front leg 16 is pivotally connected to its respective seat support 20 by a front joint 42, and is pivotally connected to its respective rear leg 18 by a wrist joint 44. Each seat support 20 is pivotally connected to its respective back support 24 by a seat joint 46. Each seat joint 46 also connects its respective seat support 20 and back support 24 to a crank 48, which is connected by a crank joint 50 to the respective rear leg 18. Finally, each arm rest 22 is pivotally connected to its respective back support 24 by an elbow joint 52, and is adjustably attached to its respective front leg 16 (at or near the wrist joint 44) by a ratchet mechanism 60.

Each member of the chair has a diameter or thickness, and conventionally all members of such chairs have been of a uniform diameter or thickness. Also, conventionally, the members of such chairs have been arranged in a stacked configuration in which they fold down against each other. Thus, for an arrangement of four side frame members, the known chairs when fully folded occupy the thickness of four side frame members.

With reference to the set-up configuration of the chair 10, as shown in FIG. 1, the left and right pluralities 12, 14 of the side frame members are spaced apart by the cross members to tension a flexible seat panel 62 and a flexible back panel 64 that are attached between the side frame members. The lower joint 34 defines a generally vertical axis A1. The upper joint 36 defines an axis A2, which may be parallel or coaxial with A1. The rear joint 38 defines an axis A3, which is skewed to A1 and A2, i.e., in the same vertical mid-plane of the chair but not vertical or parallel to A1 or to A2. The top joint 40 defines an axis A4, which is skewed to A1 . . . A3. Thus, this plurality of joints 34, 36, 38, 40 define a plurality of mutually skewed axes, all in the vertical mid-plane of the chair, about which the chair 10 cannot be folded from its set-up configuration.

The front joint 42 defines an axis A5, which is generally horizontal therefore orthogonal to A1 . . . A4. The wrist joint 44 defines an axis A6, which also is generally horizontal, parallel to A5, and thereby orthogonal to A1 . . . A4. The seat joint 46 defines an axis A7 that is generally horizontal, parallel to and offset from A5 . . . A6, and thereby orthogonal to A1 . . . A4. The crank joint 50 defines an axis A8 that is generally horizontal, parallel to and offset from A5 . . . A7, and thereby orthogonal to A1 . . . A4. The elbow joint 52 defines an axis A9 that is generally horizontal, parallel to and offset from A5 . . . A8, and thereby orthogonal to A1 . . . A4. Thus, this second plurality of joints 42, 44, 46, 50, 52 define a plurality of mutually parallel axes, about which the left and right pluralities of side frame members of the chair 10 can be folded together from the set-up configuration of the chair to a flattened configuration as shown in FIG. 2.

Figure 2:
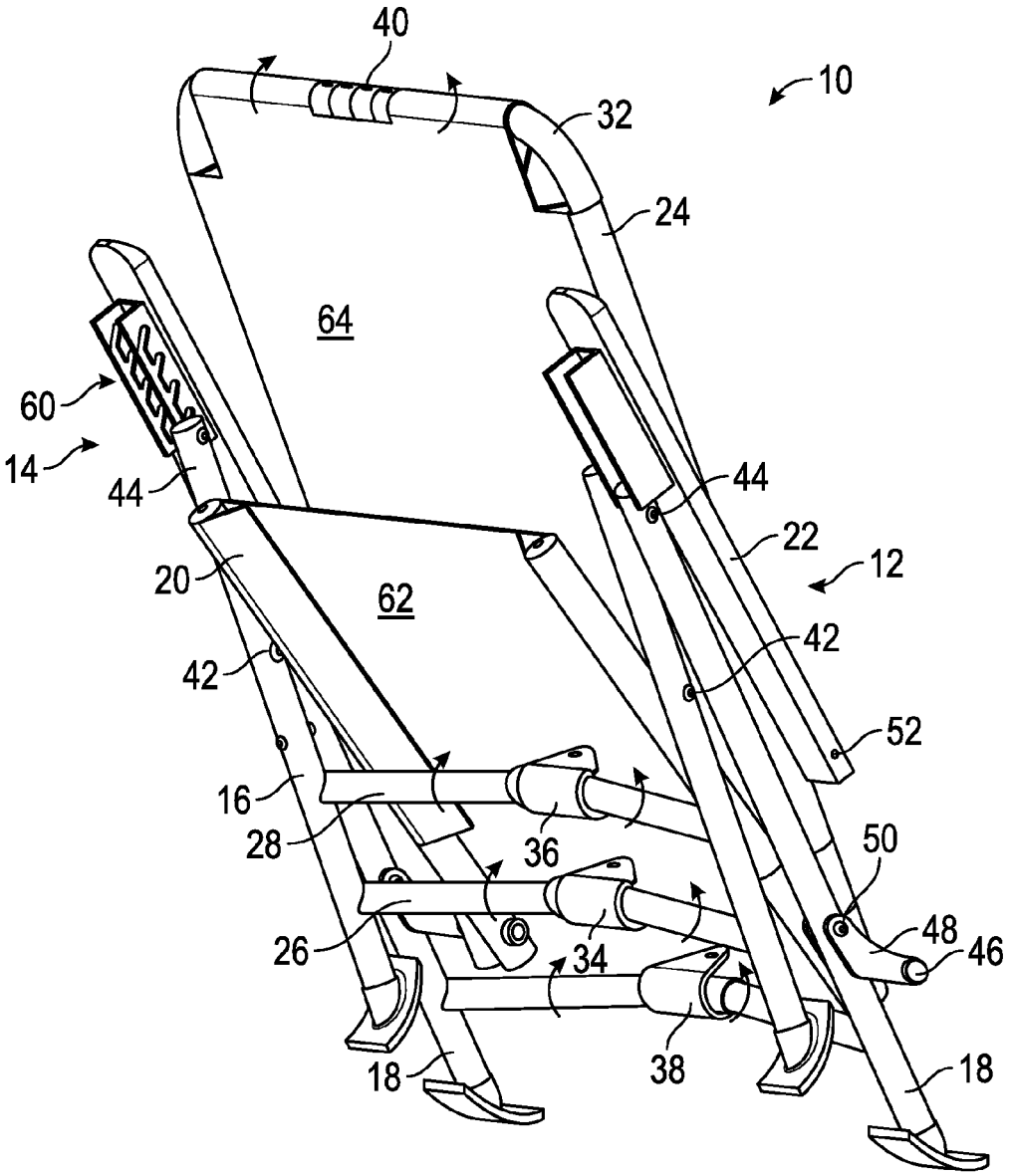
FIG. 2 shows the bi-fold chair of FIG. 1 in a flattened configuration.

Referring to FIG. 2, the chair 10 is shown in the flattened configuration. In the flattened configuration of the chair 10, the side frame members 16, 18, 20, 22, 24 of the left plurality 12 are bundled closely together while the side frame members of the right plurality 14 also are bundled closely together. The side frame members of the seat support and of the back support are nested laterally between the other side frame members (e.g., legs and armrests). Thus, the cross members or braces 26, 28, 30, 32 are brought substantially into a common plane orthogonal to the vertical mid-plane of the chair, such that the joints 34, 36, 38, 40 are brought substantially into line with each other, i.e., the formerly skewed axes A1 . . . A4 now are made substantially coaxial. In such a substantially coplanar or nested configuration, the folded chair occupies not more than about two side frame members thicknesses due to at least some of the side frame members being laterally nested (not folded against each other).

Figure 3:
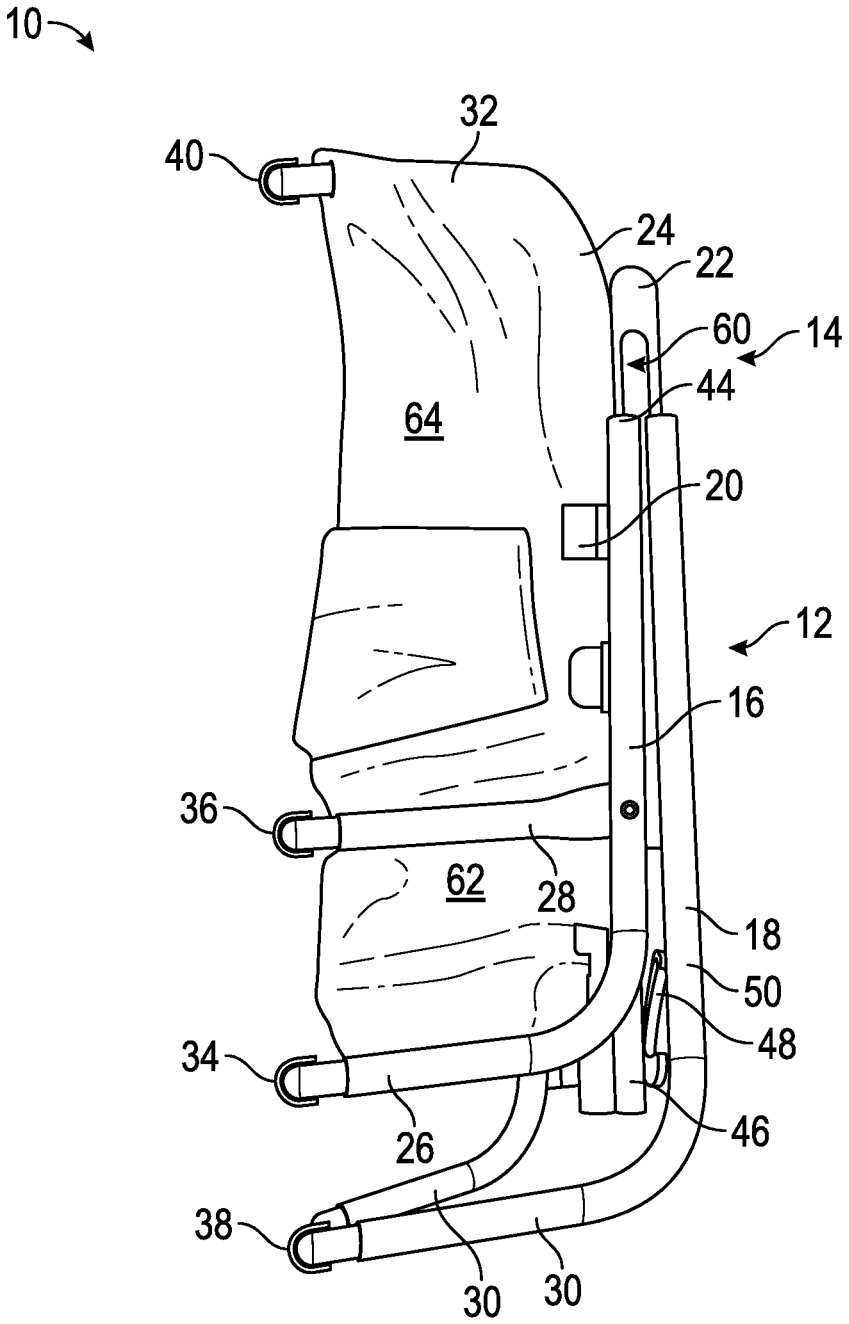
FIG. 3 shows the bi-fold chair of FIGS. 1 and 2 in a collapsed configuration.

Now from the mutually nested or flattened configuration of FIG. 2, the left and right pluralities 12, 14 of the side frame members of the chair 10 can be folded about these axes and toward the vertical mid-plane of the chair, from the flattened configuration of the chair to a collapsed configuration as shown in FIG. 3.

Of note, in certain embodiments the axes A1 . . . A4 may in the flattened configuration of the chair be brought into parallel and substantially coplanar, but not coaxial, relationships. Thus, these axes may remain sufficiently offset within the flattened configuration of the chair 10 so as to provide an "over center" or "snap fold" action as the left and right pluralities 12, 14 of side frame members are folded toward each other and toward the vertical mid-plane of the chair 10. Notably, the chair may only be folded in this manner by first placing it into its flattened condition so that the axes A1 . . . A7 are aligned in this fashion. When in the set-up condition, the skewed nature of the axes prevents the chair from collapsing about any of the joints 34, 36, 38, 40, especially when a seated user is placing pressure on the chair.

FIG. 3 shows the chair 10 in the collapsed configuration. At one side are the joints 34, 36, 38, 40. At the other side are the left and right pluralities 12, 14 of the side frame members 16, 18, 20, 22, 24. The cross members 26, 28, 30, 32 extend from their respective joints 34, 36, 38, 40 across the chair 10 to their respective side frame members 16, 18, 24. The flexible panels 62, 64 are folded within the cross members 26, 28, 30, 32. The left and right pluralities 12, 14 of side frame members have been juxtaposed. Advantageously, the chair 10 in the collapsed configuration can be transported and/or stored in approximately one half the space required for transporting the chair 10 in the flattened configuration. Total shipping perimeter also is reduced by almost 50% from the flattened configuration.

Figure 4:
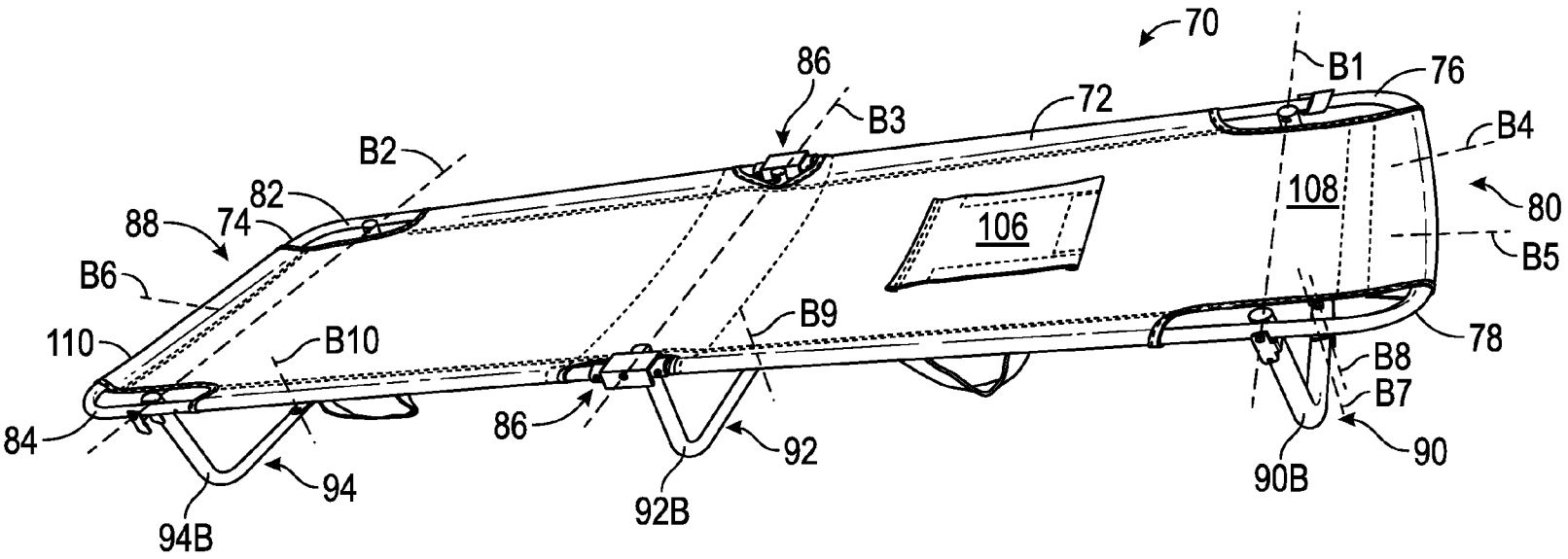
FIG. 4 shows a bi-fold cot, in accordance with a second embodiment of the present invention, in a set-up configuration.

In another embodiment of the present invention, FIG. 4 shows a set-up configuration of a bi-fold cot 70, which comprises a flexible fabric panel 72 supported on a folding frame 74. The fabric panel 72 comprises a shoulder flap 106, a head flap 108, and a foot cutout 110, which are further described below with reference to FIG. 7, which shows the cot 70 in a fully collapsed configuration. The folding frame 74 comprises upper left and right corners 76, 78 that are joined to each other by a head joint 80 and that are joined to lower left and right corners 82, 84 by waist joints 86. The lower left and right corners of the folding frame 74 are joined to each other by a foot joint 88. Thus, each corner of the folding frame includes a side frame member and also includes a cross member that is rigidly and generally orthogonally connected with the side frame member. The side frame members of the folding frame 74 are pivotally connected with each other by the waist joints 86. The cross members of the folding frame 74 are pivotally connected with each other by the head and foot joints 80, 88, which are disposed on a vertical mid-plane of the folding frame 74 and of the cot 70 as a whole.

Figure 5:
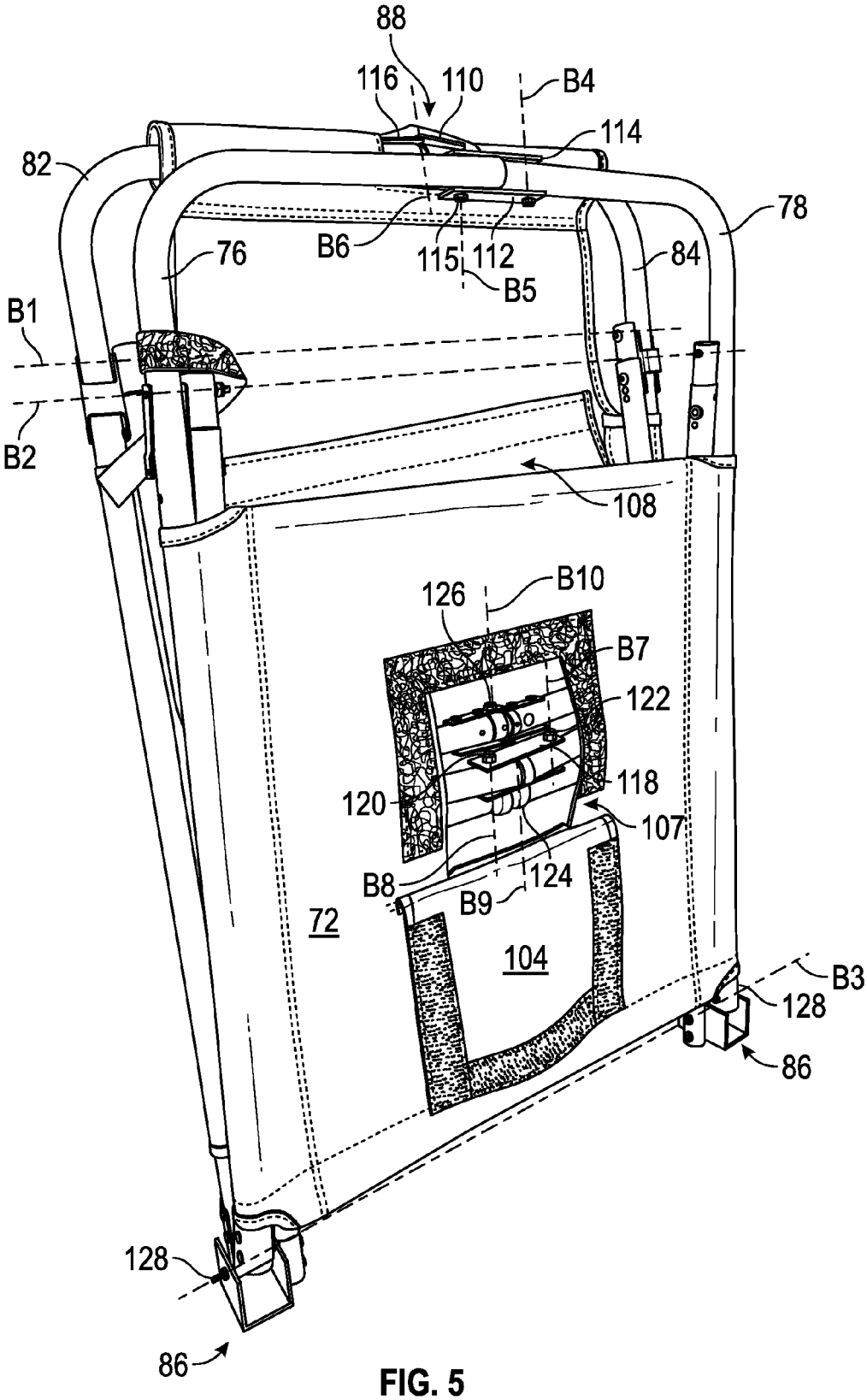
FIG. 5 shows the bi-fold cot of FIG. 4 a mutually nested (folded) configuration.

Referring also to FIG. 5, which shows a flattened or mutually nested configuration of folding the bi-fold cot 70, the folding frame 74 can be supported by upper, middle, and lower folding legs 90, 92, 94. Each folding leg has respective left and right halves A and B, which are connected to each other at respective upper, middle, or lower leg joints 96, 98, or 100. Like the head and foot joints 80, 88, the leg joints 96, 98, 100 are disposed on the vertical mid-plane of the cot 70. In FIG. 5 the legs are shown folded against the folding frame 74 by way of respective hinged connections. The middle leg 92 is hinged to all four corners of the frame 74 at the waist joints 86. The upper leg 90 is hinged to the frame's upper left and right corners 76, 78 at shoulder joints 102. The lower leg 94 is hinged to the frame's lower left and right corners 82, 84 at knee joints 104.

Like the corners of the folding frame 74, the legs include both side frame members and cross members. The side frame members are those parts of the legs that are generally vertical while the legs are supporting the folding frame. The cross members are those parts of the legs that contact the floor while the legs are supporting the folding frame. The side frame members connect to the folding frame by way of the shoulder, waist, and knee joints 102, 86, 104. The cross members connect with each other by way of the leg joints 96, 98, 100.

Notably, in the configuration of FIG. 5, the side frame members of the legs 90, 92, 94 are nested laterally within the corners of the folding frame 74. This is by contrast to conventional folding cots in which the legs fold in line with and against the side frame members or corners of the cot frame. The partly flattened configuration of FIG. 5 is enabled particularly by details of the shoulder joints 102 and of the knee joints 104, as further discussed below with reference to FIGS. 6, 7, and 11. The action of folding the legs 90, 94 about the axes B1, B2 of their respective joints 102, 104 brings most of the cross member axes B4 . . . B10 into parallel with each other in approximately the same plane defined by the folding frame 74. However, in order to bring all of the cross member axes B4 . . . B8, B10 into line with the axis B9 of the middle leg joint 98, it is necessary to further fold the cot 70 to an intermediate (nested) configuration. This further fold is accomplished from the inverted position of the cot 70 as shown in FIG. 5, and involves folding up both the head and foot portions of the cot against the middle leg 92. Due to the particular configuration of the shoulder joints 102 and of the knee joints 104, the cross members of the upper leg 90 and of the lower leg 94 naturally fall into line with the cross members of the middle leg 92.

Thus, FIG. 5 shows the nested configuration of the bi-fold cot 70 with the upper and lower corners of the frame 74 folded against each other about the axis B3 of the waist joint 86. In this configuration, the three legs—upper, lower, and middle—are nested laterally within the corners of the folding frame 74. All three of the leg joints—the upper leg joint 96, the middle leg joint 98, and the lower leg joint 100—are brought into position with their axes B7 . . . B10 parallel and substantially in a common plane. The leg joints also are positioned behind a shoulder flap 106 that is formed in the flexible panel 72. Accordingly, the shoulder flap 106 can be opened to expose the leg joints and thereby permit them to poke through the shoulder flap opening 107 during a final collapsing fold of the cot as shown in FIG. 6.

Figure 7:
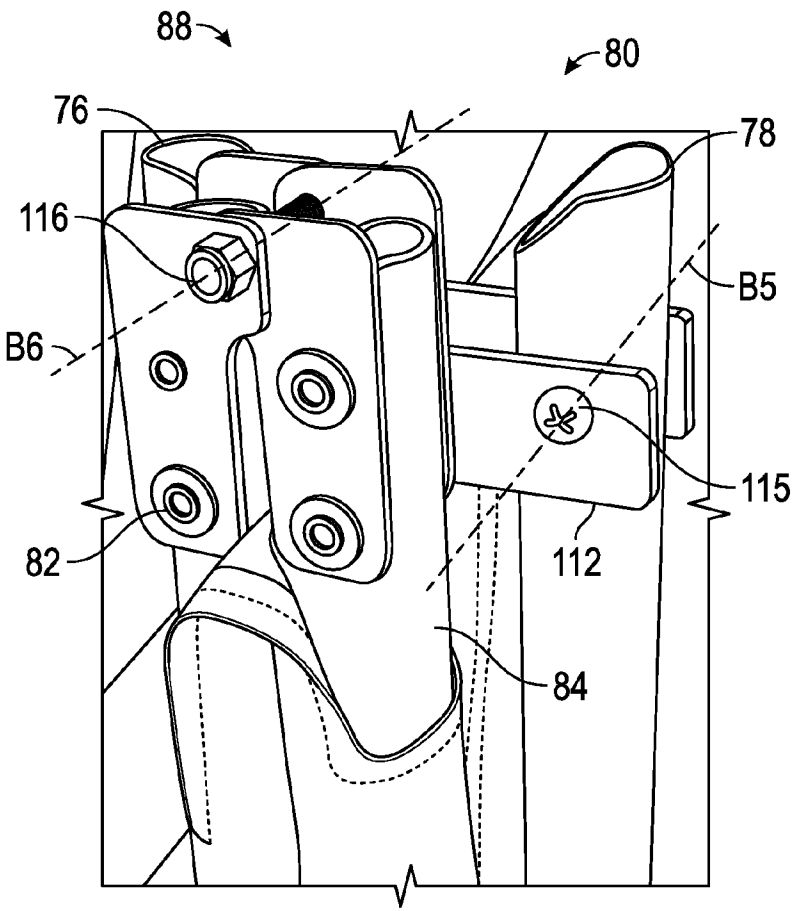
FIG. 7 shows details of head and foot joints of the bi-fold cot of FIG. 4.

Additionally, a head flap 108 of the flexible fabric panel 72 can be detached from the frame's upper left and right corners 76, 78 to permit the collapsing fold about the head joint 80. The head flap 108 may be detachable and reattachable, for example, by way of matching hook-and-loop fastener strips 109 as shown in FIG. 7. At the foot of the folding frame 74, a cutout 110 similarly permits the collapsing fold of the lower left and right corners 82, 84 about the foot joint 88.

The shoulder flap 106, the detachable head flap 108, and the foot cutout 110 are provided to obviate a potential problem with the flexible fabric panel 72 being pulled too tight during the collapsing fold of the frame 74 and possibly preventing the collapsing fold.

Figure 6:
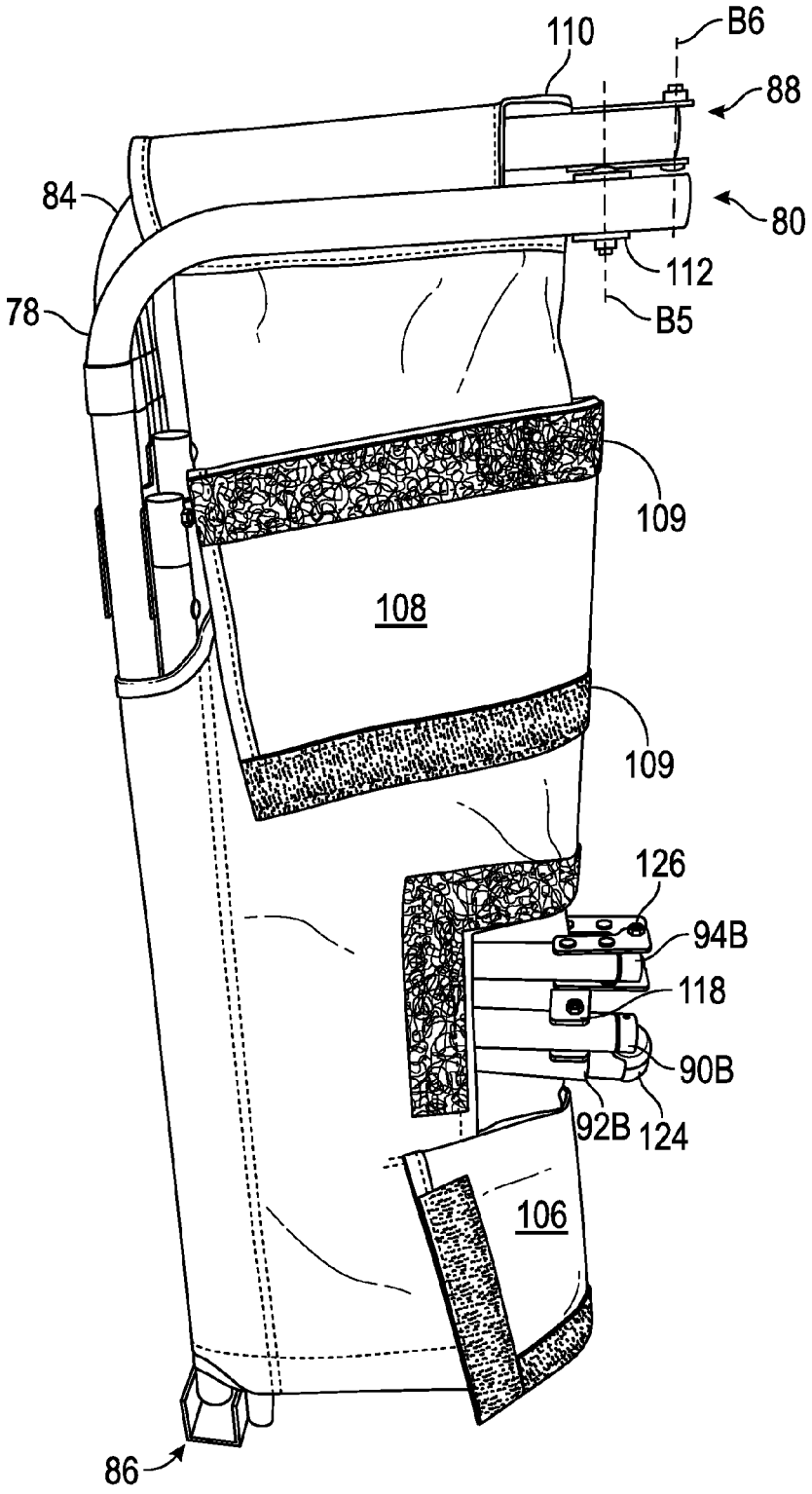
FIG. 6 shows the bi-fold cot of FIGS. 4-6 in a collapsed configuration.

Thus, from the nested configuration of FIG. 6, the cross members of the bi-fold cot 70 can be folded by a single collapsing fold to a fully collapsed configuration as shown in FIG. 6. The collapsing sequence of the cot 70 is enforced by the mutual arrangement and individual details of the various joints 80, 86, 88, 96, 98, 100, 102, 104 as further described below.

FIG. 7 shows in greater detail the head and foot joints 80, 88, which connect cross members of the frame's corners 76, 78, 82, 84. Because these two joints are not positioned exactly into a single plane in the folded condition of FIG. 6, the head joint 80 is provided with a bridge 112 that has two pivots 114, 115 hinging the frame's upper left and right corners 76, 78. The pivots 114, 115 define the axes B4 (better shown in FIG. 6) and B5. By contrast, the foot joint 88 is provided with a single pivot pin 116 that defines the axis B6. The bridge 112 permits the head joint 80 to laterally bracket around the foot joint 88 so that the two joints can be nested with each other in the collapsed configuration.

Figure 8:
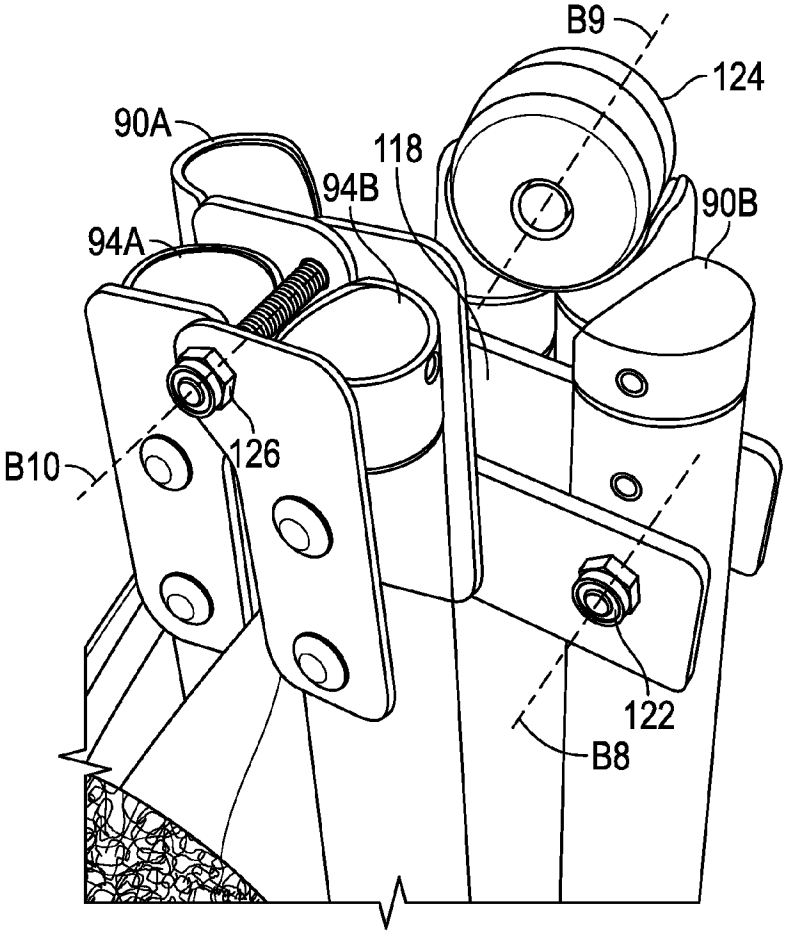
FIG. 8 shows details of leg joints of the bi-fold cot of FIG. 4.

FIG. 8 shows in greater detail the leg joints 96, 98, 100, which connect cross members of the legs 90, 92, 94. The upper leg joint 96 has a bridge 118, which is connected by respective pivots 120, 122 to the upper leg left half 90A and to the upper leg right half 90B. The pivots 120, 122 define the axes B7, B8 respectively, as discussed above. The middle leg joint 98 has a single pivot 124 that defines the axis B9. The lower leg joint 100 has a single pivot 126 that defines the axis B10.

Figure 9:
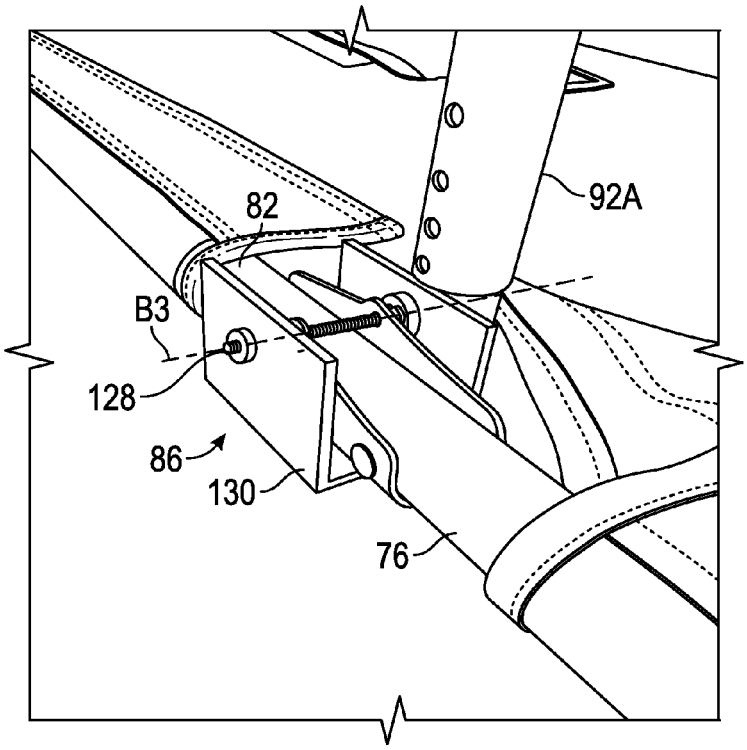
FIG. 9 shows details of a waist joint of the bi-fold cot of FIG. 4.

FIG. 9 shows details of one of the waist joints 86, which connect side frame members of the frame 74 with side frame members of the middle leg 92. The waist joint 86 includes a single pivot 128 that defines the axis B3. The pivot 128 is fastened through the middle leg left half 92A and through a bridge 130 that is rigidly attached to the middle leg 92. The bridge 130 brackets the side frame members of the frame's upper left corner 76 and lower left corner 82. The pivot 128 also is fastened through the ends of the side frame members of the corners 76, 82. When the frame 74 is folded at the waist joint 86, the frame's corners 76, 78, 82, 84 are brought to nest against the halves of the middle leg 92.

Figure 10:
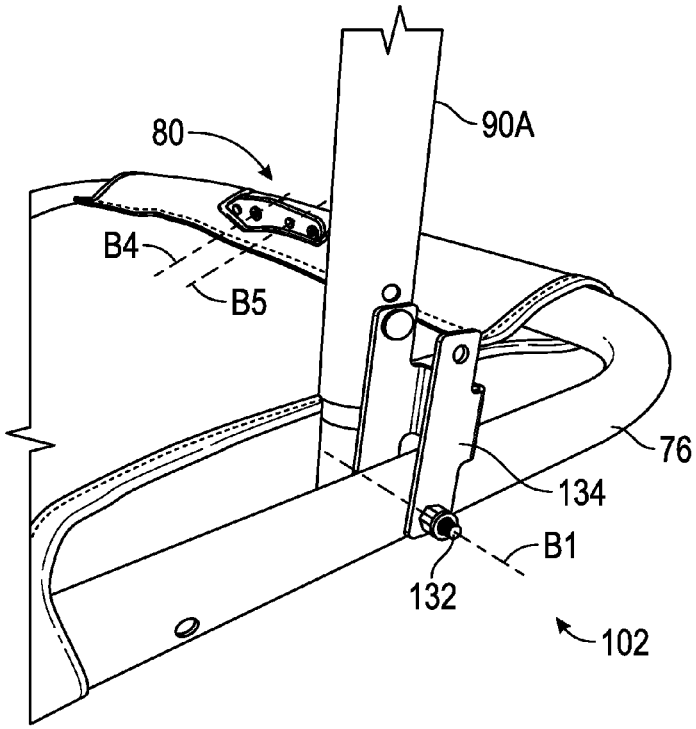
FIG. 10 shows details of a shoulder joint of the bi-fold cot of FIG. 4.

FIG. 10 shows details of one of the shoulder joints 102, which connect side frame members of the frame 74 with side frame members of the upper leg 90. Not shown in detail are the knee joints 104, which connect side frame members of the frame 74 with side frame members of the lower leg 94. The knee joints 104 can be substantially similar to the shoulder joints 102, each of which includes a pivot 132 that hinges a side frame member of the upper leg 90 to one of the side frame members of the frame 74, as well as a bridge 134 that is rigidly attached to the side frame member of the upper leg 90. The bridge 134 brackets around the side frame member 76 of the folding frame 74, so that the pivot 132 can be inserted through the bridge 134 at both inner and outer sides of the folding frame 74. Thus, the bridge 134 strengthens the shoulder joint 102 against torsion, and also permits folding the upper leg 90 into the plane defined by the folding frame 74, in a nested fashion as discussed above with reference to FIG. 5. Additionally, the bridge 134 acts as a stop link that prevents folding the upper leg 90 beyond the plane defined by the folding frame 74. Thus, the bridge 134 helps to define the partly flattened and mutually nested configurations of the cot 70.

Referring to FIGS. 4-11, each of the several joints of the bi-fold cot includes one or more pivots, with each pivot defining an axis for folding the cot.

In a group of "side frame member" axes that are generally parallel with each other in the set-up configuration of FIG. 4, the shoulder joints 102 define an axis B1; the knee joints 104 define an axis B2; and the waist joints 86 define an axis B3 (better seen in FIG. 9). All the side frame member axes B1 . . . B3 extend generally in a plane defined by the folding frame 74. Thus, from the set-up configuration, the side frame members of the bi-fold cot 70 can be folded to a nested configuration about these axes B1 . . . B3.

In a group of "cross member" axes that are not parallel with each other in the set-up configuration of FIG. 4, the head joint 80 defines axes B4, B5 (better seen in FIG. 7) and the foot joint 88 defines an axis B6. These three axes B4 . . . B6 extend generally in the plane defined by the folding frame 74, but orthogonally to the group of axes B1 . . . B3. The upper leg joint 96 defines axes B7, B8, the middle leg joint 98 defines an axis B9, and the lower leg joint 100 defines an axis B10. These four axes B7 . . . B10 extend generally orthogonally to the plane defined by the folding frame 74. From the set-up configuration, the bi-fold cot 70 cannot be folded about the second group of axes B4 . . . B10. Thus, this group of cross member axes B4 . . . B10 essentially "lock" the bi-fold cot 70 into its set-up configuration until the cot is folded according to the steps as shown in FIGS. 5-7.

Referring again to FIG. 6, a single collapsing fold about the cross member axes B4 . . . B10 brings the bi-fold cot 70 from the folded configuration of FIG. 6 into a fully collapsed configuration. Note that the middle leg joint 98 is folded about its two axes B9, B10 so as to accommodate (nest around) the single pivots of the upper and lower leg joints 96, 100. Similarly, the head joint 80 is folded about its two axes B4, B5 so as to nest around the single pivot of the foot joint 88.

In the collapsed configuration, the frame 74 and the legs 90, 92, 94 all have been folded about all of their respective axes B1 . . . B10. As a result, the bi-fold cot 70 is collapsed to a reduced shipping envelope, compared to its shipping envelope in either configuration of FIGS. 4-6. For example, the bi-fold cot in the mutually nested configuration of FIG. 6 may have a shipping perimeter of 635 mm×945 mm×65 mm, for a total shipping perimeter of 3890 mm. By contrast, in the collapsed configuration of FIG. 6, the bi-fold cot 70 may have a total shipping perimeter of as little as 3385 mm.

Similar to what is described with reference to the bi-fold chair embodiment illustrated in FIGS. 1-3, at least some of the plurality of cross member axes B4 . . . B10 of the bi-fold cot may be somewhat offset from each other, i.e., substantially parallel but not co-axial, in the mutually nested configuration of FIG. 6. Such an arrangement of axes can provide an "over center" or "snap fold" action during the collapsing fold of the cot 70.

Although exemplary embodiments of the invention have been described with reference to attached drawings, those skilled in the art nevertheless will apprehend variations in form or detail that are consistent with the scope of the invention as defined by the appended claims.

What is claimed is:

1. A folding furnishing apparatus comprising:

a plurality of first members;

a plurality of second members that support the plurality of first members in a set-up configuration of the furnishing;

a panel supported by the first and/or second members for supporting an occupant of the furnishing in a set-up configuration of the furnishing;

a plurality of first joints that pivotally interconnect each of the second members with at least one other second member, wherein the plurality of first joints in the set-up configuration of the furnishing define a first plurality of mutually parallel axes extending in a first axial direction about which the second members can be folded from the set-up configuration of the furnishing to a mutually nested configuration of the furnishing; and a plurality of second joints that connect members of the plurality of first members to one another, and that in the set-up configuration of the furnishing define a plurality of mutually skewed axes about which the furnishing cannot be folded, thus locking the first members in extended positions in the set-up configuration of the furnishing, wherein the plurality of second joints in the mutually nested configuration of the furnishing define a second plurality of mutually parallel axes extending in a second axial direction generally orthogonal to the first axial direction about which the first members can be folded from the mutually nested configuration of the furnishing to a collapsed configuration of the furnishing, in which the first members take folded positions.

2. The apparatus of claim 1 wherein the furnishing is a chair.

3. The apparatus of claim 1 wherein the panel includes at least one cutout coincident with at least one of the first or second joints.

4. The apparatus of claim 3 wherein the cutout is coincident with at least one of the plurality of second joints in the mutually nested configuration of the furnishing.

5. The apparatus of claim 4 wherein the at least one of the plurality of second joints protrudes through the cutout in the collapsed configuration of the furnishing.

6. The apparatus of claim 1 wherein at least one of the plurality of first joints includes a bridge that brackets around one of the first members, said bridge acting as a stop link to define the mutually nested configuration of the furnishing.

7. The apparatus of claim 1 wherein at least one of the plurality of second joints includes a bridge that brackets around another of the second joints in the collapsed configuration of the furnishing.

8. The apparatus of claim 1 wherein at least two of the second joints define axes that are parallel but not coaxial in the mutually nested configuration of the furnishing.

9. The apparatus of claim 1 wherein the plurality of second joints define axes that are substantially coplanar but not coaxial in the mutually nested configuration of the furnishing.

10. The apparatus of claim 1 wherein at least some of the plurality of first joints in the collapsed configuration of the furnishing define offset axes about which the furnishing cannot be unfolded from the collapsed configuration.

11. A folding furnishing apparatus comprising:

symmetric left and right pluralities of side frame members;

cross members joining the left and right pluralities of side frame members;

a panel supported by the side frame members and/or the cross members for supporting an occupant of the furnishing;

a plurality of cross member joints connecting the cross members at a vertical mid-plane of the furnishing; and symmetric left and right pluralities of side frame member joints connecting the respective symmetric left and right pluralities of side frame members among each other and with the cross members, wherein the furnishing has a set-up configuration in which the plurality of cross member joints define a plurality of mutually skewed axes about which the furnishing cannot be folded from the set-up configuration, while the symmetric left and right pluralities of side frame member joints define a plurality of mutually parallel axes about which the furnishing can be folded from the set-up configuration to a flattened configuration, and in the flattened configuration, the plurality of cross member joints then define a plurality of mutually parallel axes about which the furnishing can be folded from the flattened configuration to a collapsed configuration.

12. The apparatus of claim 11 wherein the furnishing is a chair.

13. The apparatus of claim 11 wherein the panel includes at least one cutout coincident with at least one of the cross member joints or at least one of the side frame member joints.

14. The apparatus of claim 13 wherein the cutout is coincident with at least one of the plurality of cross member joints in the flattened configuration of the furnishing.

15. The apparatus of claim 14 wherein the at least one of the plurality of cross member joints protrudes through the cutout in the collapsed configuration of the furnishing.

16. The apparatus of claim 11 wherein at least one of the plurality of side frame member joints includes a bridge that brackets around one of the cross members, said bridge acting as a stop link to define the flattened configuration of the furnishing.

17. The apparatus of claim 11 wherein at least one of the plurality of cross member joints includes a bridge that brackets around another of the cross member joints in the collapsed configuration of the furnishing.

18. The apparatus of claim 11 wherein at least two of the plurality of cross member joints define axes that are parallel but not coaxial in the flattened configuration of the furnishing.

19. The apparatus of claim 11 wherein the plurality of cross member joints define axes that are substantially coplanar but not coaxial in the flattened configuration of the furnishing.

20. The apparatus of claim 11 wherein at least some of the plurality of side frame member joints in the collapsed configuration of the furnishing define offset axes about which the furnishing cannot be unfolded from the collapsed configuration.

21. A folding chair comprising:

left and right front legs;

left and right rear legs pivotally connected to the respective front legs at wrist joints;

left and right seat supports pivotally connected to the respective front legs at front joints;

left and right back supports pivotally connected to the respective seat supports by seat joints;

left and right cranks pivotally connected to the seat joints and pivotally connected to the respective rear legs by crank joints;

left and right arm rests pivotally connected to the respective back supports at elbow joints;

left and right lower front leg braces rigidly attached to their respective front legs and mutually pivotally connected by a lower pivot;

left and right upper front leg braces rigidly attached to their respective front legs and mutually pivotally connected by an upper pivot;

left and right rear braces rigidly attached to their respective rear legs and mutually pivotally connected by a rear pivot;

left and right top braces rigidly attached to their respective back supports and mutually pivotally connected by a top pivot; and at least one flexible panel supported among the seat supports and the back supports;

wherein the chair has a set-up configuration in which the lower and upper front leg braces, rear braces, and top braces are in extended positions to space apart the left and right seat supports and back supports to hold the panel as a seat for an occupant, while the left and right seat supports are at an oblique angle from the left and right back supports;

wherein the lower pivot, the upper pivot, the rear pivot, and the top pivot define a plurality of first axes that are mutually skewed in the set-up configuration of the chair, while the wrist joints, front joints, seat joints, crank joints, and elbow joints define a plurality of second axes that are mutually parallel in the set-up configuration of the chair;

wherein the chair can be folded from the set-up configuration about the plurality of second axes to a flattened configuration in which the left front leg, rear leg, arm rest, seat support, and back support are juxtaposed at a left side and the right front leg, rear leg, arm rest, seat support, and back support are juxtaposed at a right side, and in which the plurality of first axes become substantially mutually parallel with the lower and upper leg braces, the rear braces, and the top braces still in their extended positions;

wherein the chair can be folded from the flattened configuration about the plurality of first axes to a collapsed configuration, in which the left and right front and rear legs, arm rests, seat supports, and back supports all are juxtaposed with the lower and upper leg braces, the rear braces, and the top braces all in folded positions about their respective joints;

wherein the chair cannot be folded from the set-up configuration about the plurality of first axes, such that in the set-up configuration the lower and upper leg braces, the rear braces, and the top braces all are locked in their extended positions.

22. A folding portable furnishing apparatus comprising:

lengthwise foldable cross members with cross member joints;

side frame members that support a flexible panel for receiving an occupant and/or support the cross members; and pivots connecting the side frame members with each other, wherein at least some of the side frame members are laterally nested within others of the side frame members, so that all of the side frame members can be folded about the pivots into a substantially common plane, and wherein after the side members are folded into the substantially common plane, each cross member is folded about its respective cross member joint into the substantially common plane with the side frame members in a lengthwise nested fashion.

23. The apparatus of claim 22 wherein each of the cross members and the side frame members has substantially the same thickness as the others of the cross members and the side frame members, and the apparatus in a fully collapsed configuration occupies no more than about two thicknesses of the members.

* * * * *